United States Patent [19]

Laumer

[11] 4,241,881

[45] Dec. 30, 1980

[54] FIBER SEPARATION FROM PULP SHEET STACKS

[75] Inventor: Edward P. Laumer, Oshkosh, Wis.

[73] Assignee: Kimberly-Clark Corporation, Neenah, Wis.

[21] Appl. No.: 56,827

[22] Filed: Jul. 12, 1979

[51] Int. Cl.[3] ..... B02C 13/286

[52] U.S. Cl. ..... 241/28; 241/186.1

[58] Field of Search ..... 241/27, 28, 189 R, 186 R, 241/186.1, 277, 186.2

[56] References Cited

U.S. PATENT DOCUMENTS

| | | | |
|---|---|---|---|
| 1,263,357 | 4/1918 | Andersen et al. | 241/28 X |
| 2,596,015 | 5/1952 | Dunwody | 241/28 X |
| 3,519,211 | 7/1970 | Sakulich et al. | 241/28 X |

FOREIGN PATENT DOCUMENTS

| | | | |
|---|---|---|---|
| 2245936 | 3/1973 | Fed. Rep. of Germany | 241/189 R |

*Primary Examiner*—Mark Rosenbaum

*Attorney, Agent, or Firm*—William D. Herrick; Stephen R. May

[57] ABSTRACT

A method for separating fibers from a stack of pulp sheets. The stack of pulp sheets is fed slowly and continuously to the fiberizing means of fiberizing apparatus and in shingled relation so that the tails of individual sheets are presented singly to the fiberizing means. The fiberizing apparatus may be conventional hammermill or pulp picking equipment and suitably includes an output screen to limit the size of unfiberized particles which may pass from the fiberizer.

13 Claims, 8 Drawing Figures

FIBER SEPARATION FROM PULP SHEET STACKS

BACKGROUND OF THE INVENTION

The present invention is particularly intended and adapted for separating fibers from a stack of pulp sheets and involves a substantially continuous feeding of the pulp sheets to a rotating fiberizing means. The continuous feeding of substantially indefinite lengths of pulp webs to a pulp fiberizer has been well known. Pulp sheets, as distinct from such continuous webs, are commonly relatively short and thick—about 0.050" thickness—and are about 32" long by 28" wide.

These pulp sheets, when employed, have been manually fed, frequently singly, to the fiberizing equipment, a practice involving considerable cost and labor. Importantly, feeding of a plurality of the thick sheets in superposed stacked relation poses problems with respect to the controlled feeding of the sheets. Stack feeding has been accomplished with toothed pull rolls, for example, to feed the stack at a controlled rate to the fiberizing means. Such rolls grip the stack of sheets positively over a major portion of the length of a stack and serve well to control the feed while they are in engagement with the stack. However, mechanical limitations of the equipment setups have prevented gripping means such as the toothed rolls from restraining the sheet stack during the fiberizing of the full length of the stack. Consequently, a free tail of each sheet of a stack has existed in sheet stack feeds, that is, there are a plurality of superposed tails. These tails have been drawn by the action of the revolving fiberizing means into the fiberizing equipment essentially unrestrained and the action is such that the tails move together and much more rapidly than is desired to the fiberizing means, resulting in a considerable number of unfiberzed fragments and damage to the equipment. Such fragments have required further fiberizing action to make the fibers suitable for use in many operations.

In addition to the generation of much unfiberized material, the feeding of a plurality of superposed sheets has caused a corresponding number of tails to be drawn, not only simultaneously but explosively into the fiberizing equipment. The sound developed is such as to require operators to be equipped with ear plugs and the like.

Applicant has found that the problems associated with unwanted sound and unfiberized material in the fiberizing of stacks of pulp sheets may be alleviated without sacrificing production capability and while maintaining or improving fiber quality. In fact, since the feed of the shingled sheets is continuous relative to ordinary slab feeding or roll feeds, productivity may be increased with the present system.

SUMMARY OF THE INVENTION

The present invention is based on the finding that, if the individual pulp sheets are presented to the rotating fiberizing means in shingled array, then only one unrestrained pulp sheet tail need be directed to the fiberizing means at a time and this pulp sheet tail is more readily fiberized than if a plurality of tails in superposed relation are fed to the fiberizing apparatus. This fiberizing of the tail occurs within the mill by the repeated hitting action of hammers or the like on the tail. Bars or serrated surfaces may be provided on the interior wall of the mill to aid this fiberizing. The fiberizing of the tails singly is much more readily and thoroughly accomplished than if a plurality are injected into the mill at one time.

By shingling, the number of sheets in a stack presented to the fiberizing means may be essentially the same in number as in conventional stacking procedures so that production rates are maintained. For example, with sheets 28" in length at a 2" overlap of the sheets, the number of sheets presented to the fiberizing means is 14, a number which is very adequate for commercial production operations.

An additional advantage of shingling may be realized by employing mechanical sheet feeders of the type employed to stream feed sheets to printing presses and the like. Such feeders may be operated remote from the hammermills with a minimum of personnel and such personnel are not exposed to the high noise levels of hammermills. Additionally, the present system permits the ready use of bale pulp.

Other objects and advantages of the invention will be apparent from the following detailed description and accompanying drawings.

DESCRIPTION OF THE PREFERRED EMBODIMENT

Figure 1:
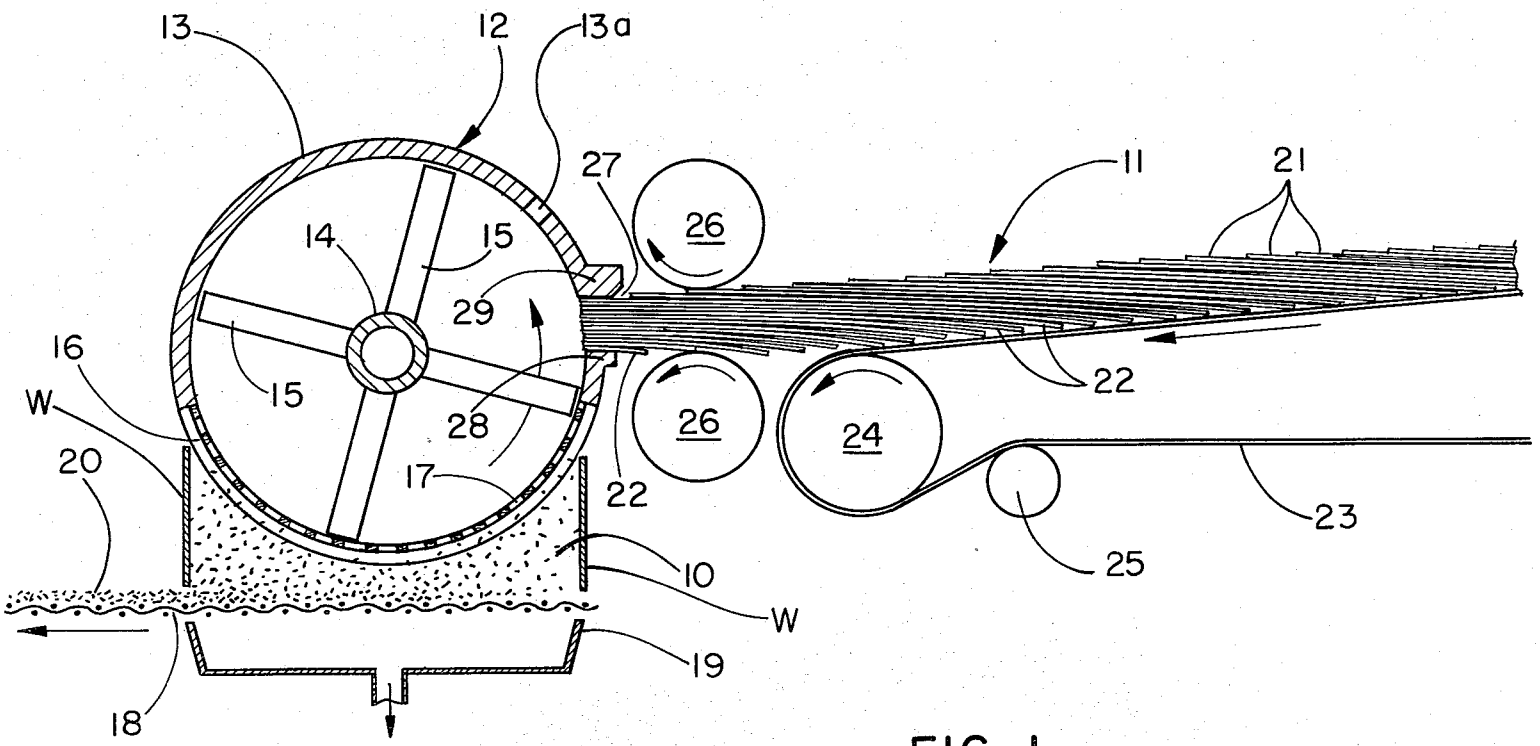
FIG. 1 is a fragmentary and schematic side elevational view of an apparatus arrangement of the invention illustrating the method of separating fibers from a stack of pulp sheets.
Figure 2:
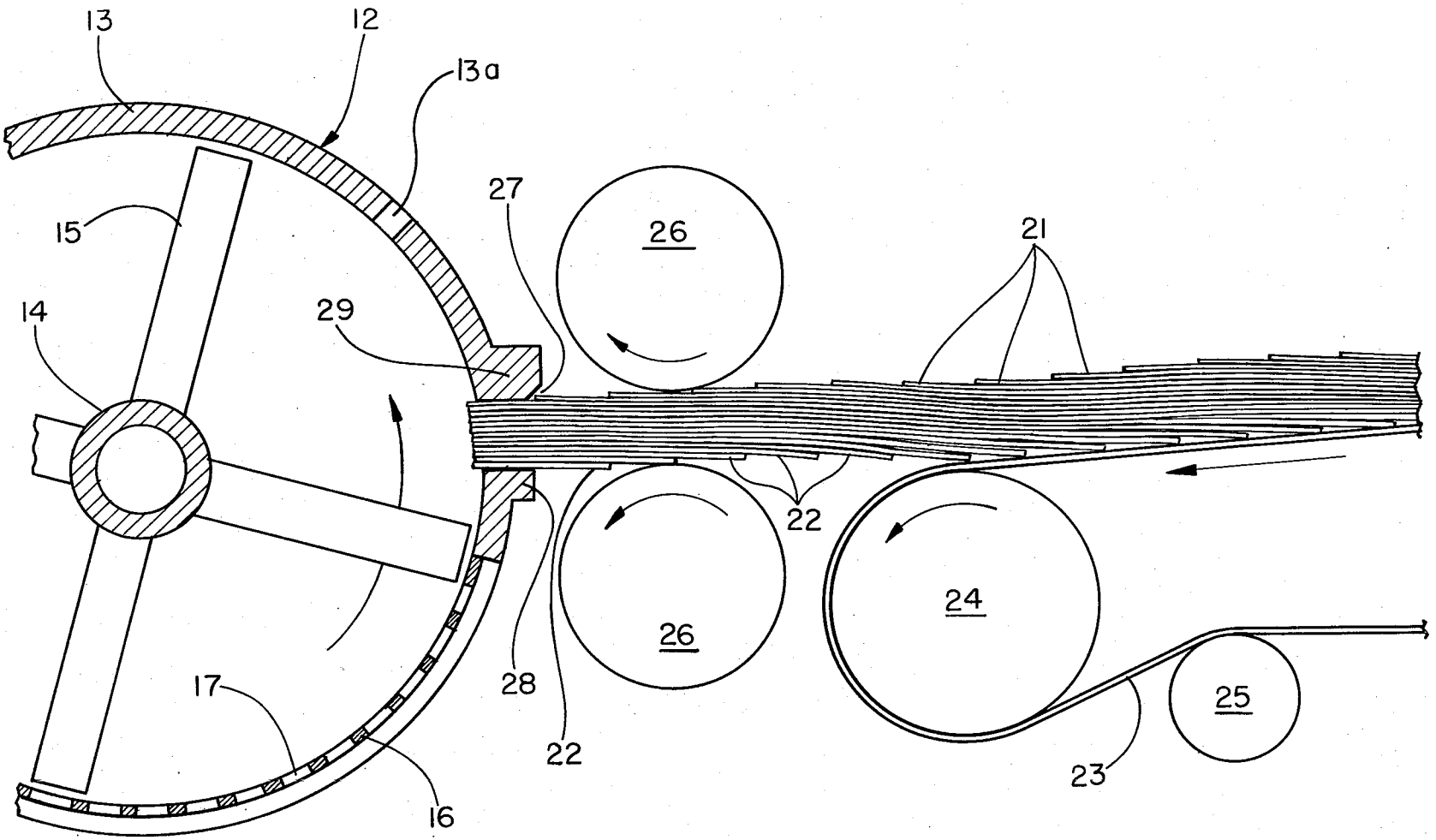
FIG. 2 is an enlarged view of a portion of the apparatus of FIG. 1.

A preferred embodiment of the invention illustrated in FIGS. 1 and 2 is particularly directed to separating fibers 10 from a stack 11 of pulp sheets. The fiberizing apparatus illustrated is a hammermill 12 having a casing 13, air inlet opening 13*a*, rotor 14 and hammers 15. The hammers rotate in the direction indicated by the arrow. In the present instance the rotation is illustrated as anticlockwise.

The casing 13 includes a foraminous hammermill screen 16 having relatively large diameter holes 17. The fiberized material sufficiently separated from the stack of pulp sheets passes the screen and falls onto a foraminous belt 18 moving in the direction indicated by the arrow transversely of the hammermill. A vacuum box 19 positioned below the belt 18, walls W and hammermill 12 are provided to aid the deposition of the fibers on the foraminous belt to form a web 20. The air from the air-fiber mix of the hammermill passes outwardly from the vacuum box 19 as indicated by the arrow. Alternatively, the fibers emanating from the hammermill may, in admixture with the air, be fed directly through conduits or the like to a point of use.

The stack 11 of pulp sheets is arranged with the sheets in shingled relation. The individual sheets are indicated by the numeral 21 and the sheet tails are designated at 22. The stack 11 is fed on a conveyor belt 23 partially shown in FIG. 1 from a shingling station (not shown). The conveyor belt includes carrying pull roll 24 and tension adjustment pulley 25. The feed of the stack 11 in full operation of the equipment is directed to a pair of pull rolls 26 which draw the stack 11 from the conveyor belt and feed it toward the opening 27 (FIG. 2) of the hammermill.

The shingling station (not shown) is suitably a conventional stream feeder available commercially from a number of manufacturers and commonly employed for feeding sheets in shingled relation to a printing press hopper or the like. U.S. Pat. No. 4,062,532 illustrates one form of mechanism for effecting shingling. The shingling action may also be by hand if desired and the specific mode and mechanism of shingling is not critical to this invention. The feed rate of the stack is suitably between two feet to ten feet per minute but may be greater or less depending on the specific nature of the pulp material and the fiberization required.

The pull rolls 26 direct the stack as a unit toward the hammermill 12. The rolls may have a friction surface or may comprise gear teeth to effect positive feed of the stack 11. The rolls are preferably positioned quite close to the hammermill casing but some spacing is necessary, and a pulp sheet tail 22 commonly lies relatively free between the pull roll and the casing of the hammermill. Such a tail is clearly shown in FIG. 1 and is the lowermost sheet of the stack as the stack lies in the opening 27 between the casing wall portion 28 and the bed bar 29. Bed bar 29 projects into the interior of the hammermill and supports the stack as the hammers 12 impact against the forward extremity of the stack.

It is to be noted from the foregoing that one tail at a time is presented to the hammers of the mill 13. This tail, if drawn to the interior of the mill quickly by the hammer rotations, causes relatively few fiber clumps to circulate within the mill and to be acted upon by the hammers before passage through the screen. In contrast, the feeding of a stack of the sheets in overlying relation in registry causes a plurality of the registered tails to approach the mill together. These, by the action of the hammers, are then drawn rapidly into the mill with incomplete fiberizing of each of the tails requiring much work by the hammers to reduce the clumps for passage through the screen.

Figure 3:
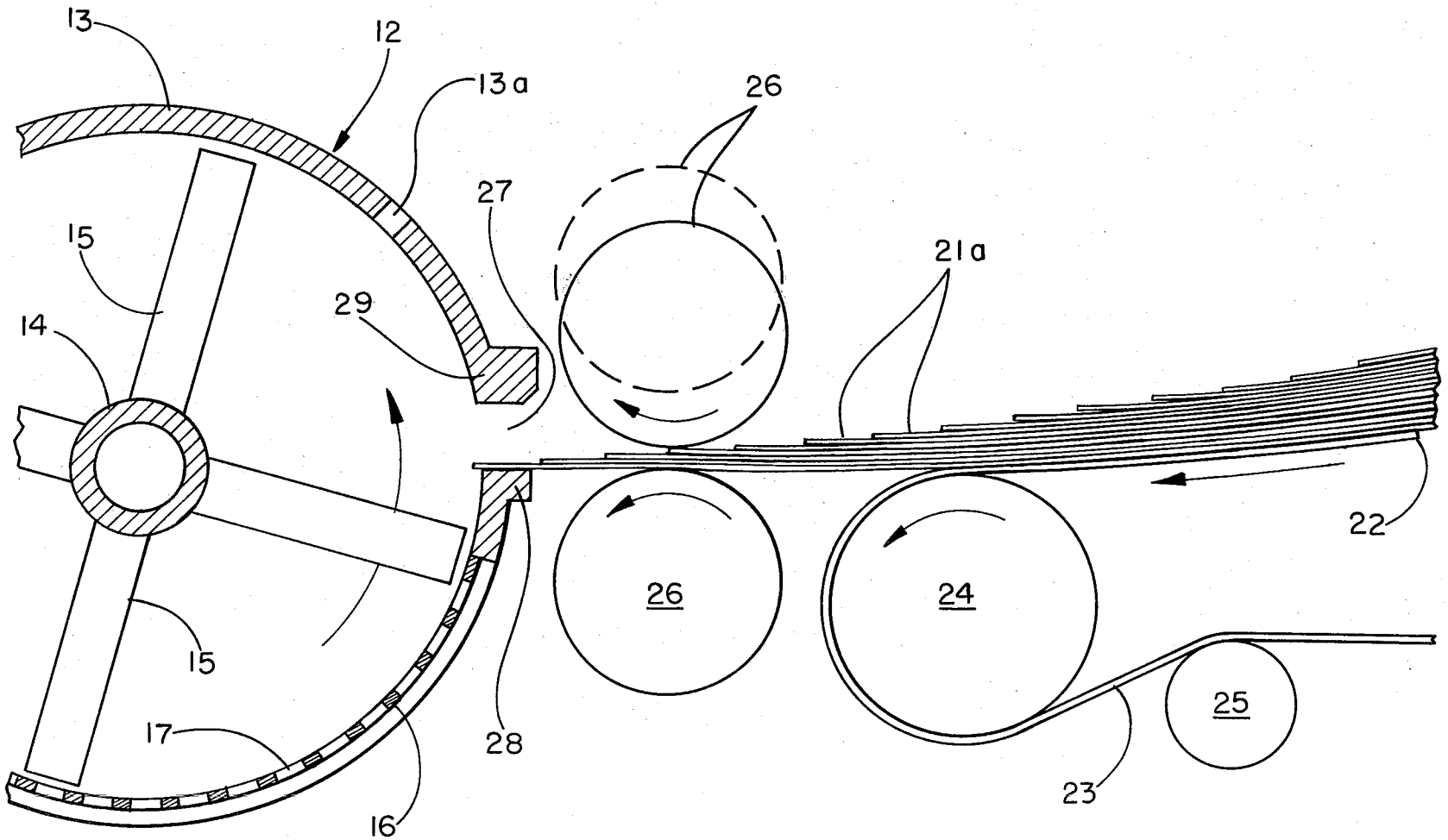
FIG. 3 is a view similar to that of FIG. 2 but illustrating the initiation of the feed of shingled pulp sheets to a hammermill.

FIGS. 1 and 2 illustrate the action of the equipment in full operation with a stack of 14 sheets being presented to the hammers 15. FIG. 3 illustrates the initiation of the feed of the stack to the hammermill. For this purpose the upper pull roll 26 of the pull roll pair is biased by suitable spring means (not shown) of conventional character toward the lower pull roll. As the initial shingled sheets of the stack (FIG. 3) are presented to the mill, the rolls cooperate to exert pressure on the starter sheets indicated by the numeral 21*a*. This prevents rapid withdrawal by the hammer action of the starter sheets as a unit into the mill and aids overall fiberizing of the starter sheets. As the stack builds to its normal height, 14 sheets in the instance of FIG. 1, the upper pull roll retracts continuing to exert pressure on the advancing sheet.

In the arrangement of FIGS. 1 and 2, the lowermost sheet of the stack 11 is fed to the mill at or just above the center line of the rotor 14. There is in this arrangement some small tendency for the hammer 15, as it contacts the lowermost sheet in its anti-clockwise rotation, to raise the lowermost sheet or tail 22 from the casing portion 28 and urge it toward the remaining sheets and the bed bar 29. Such tendency may cause the tail to be drawn into the mill relatively quickly, depending upon several factors including the friction effect of the upper sheets on tail 22, the extent to which the tail 22 is raised from the casing portion 28 and the pull or push of the hammers on the tail. The tendency to raise the lowermost tail may be minimized by providing the position of the stack to be further above (FIGS. 1 and 2) the horizontal center line of the rotor, or by reversing the direction of rotation of the hammers and the position of the bed bar.

Figure 4:
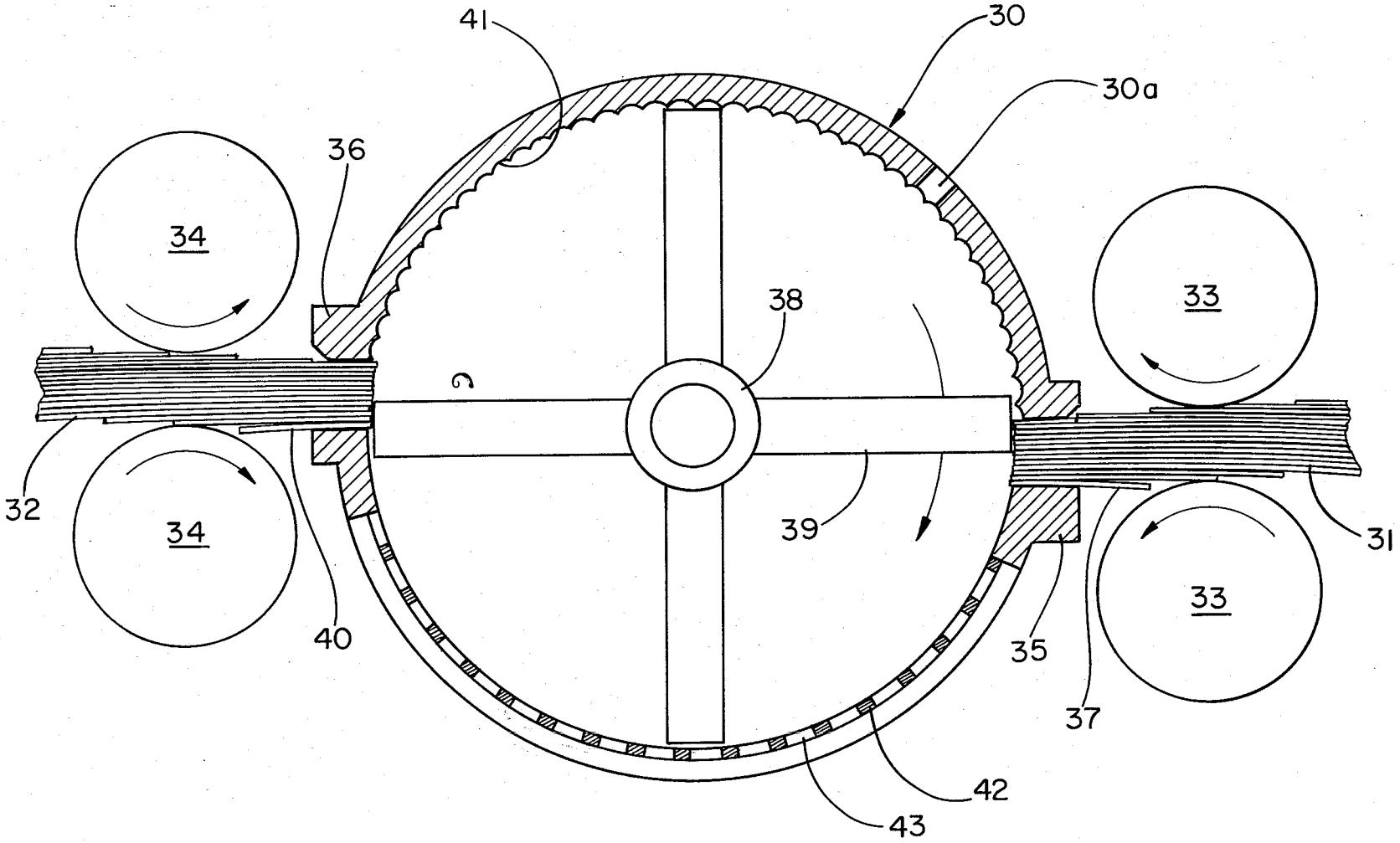
FIG. 4 is a schematic view in side elevation of a hammermill having a feed of shingled pulp sheets entering the mill from opposite sides.

Referring now to FIG. 4, the hammermill 30 is shown as being fed from opposite sides with shingled stacks 31 and 32 of pulp sheets. A first pair of pull rolls 33 feeds stack 31 and a second pair of pull rolls 34 feeds stack 32. The feed of stack 31 is over bed bar 35 and the feed of stack 32 is over bed bar 36. The tail 37 of the lowermost sheet of stack 31 is well below the center line of the rotor 38. The tendency for tail 37 to be drawn rapidly by the action of the hammers 39 into the mill will be minimized when the hammer rotation is in the clockwise direction shown in FIG. 4. The stack 32, in contrast, has its lowermost sheet or tail 40 at about or just above the horizontal center line of the rotor to better accommodate the clockwise rotation and direction of hammer impact. In the instance of FIG. 4, the interior surface of the mill is serrated at 41 to aid fiberizing of pulp sheet particles to a size to pass through the screen 42. The size of the screen apertures 43 is determined by the degree to which fiberizing is to take place for the particular usage of the fiberized material. In some instances recycling of all of the material or a fraction having the larger clumps may be desired.

Figure 5:
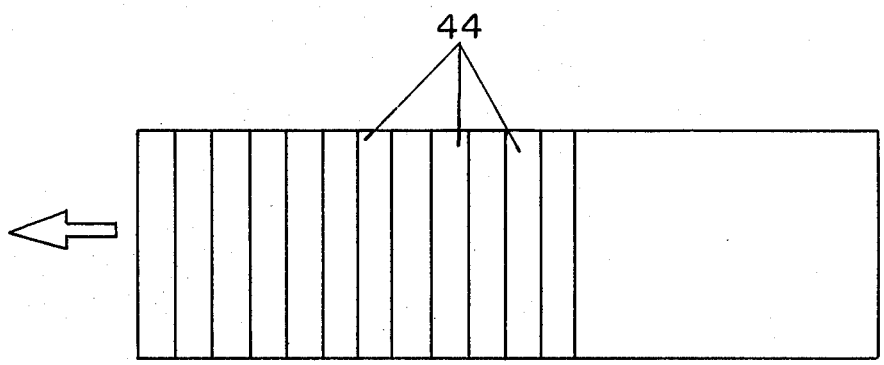
FIG. 5 is a plan view illustrating one mode of presenting shingled sheets to the hammermill.

The particular mode of overlapping the sheets of the stack is not critical. As illustrated in FIG. 5, the successive sheets 44 may be simply overlapped a predetermined and preferably consistent length. Sheets having a length of 28" may be overlapped 2" to provide in the stack a thickness for full operation of 14 sheets. An overlapping of 4" would provide a thickness of 7 sheets.

Figure 6:
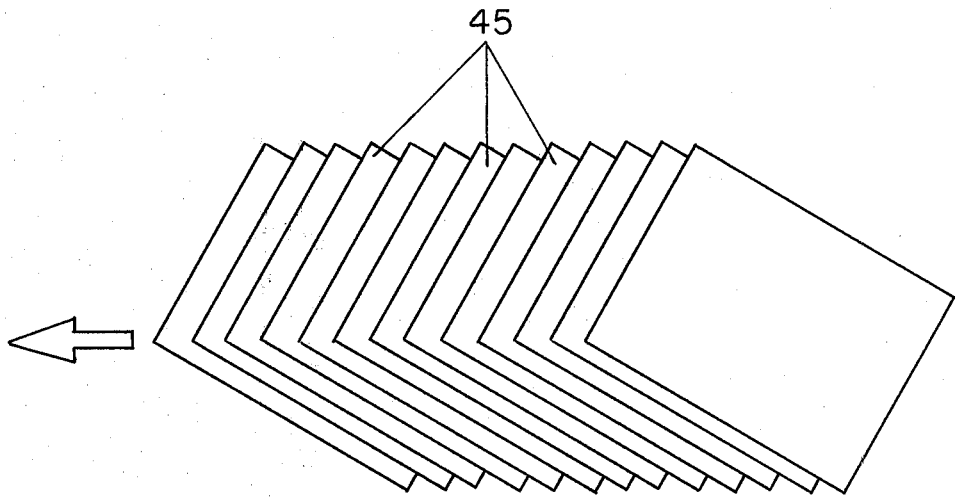
FIG. 6 is a plan view of yet another mode of presenting shingled sheets to a hammermill.

With a given sheet width the extent of an edge to be presented to the mill hammers is governed by the angle of presentation of the sheets to the hammers. As illustrated in FIG. 6, feeding the sheets 45 in shingled relation at an angle of 45° to the line of travel increases the extent of sheet edge presented to the mill and hammers and minimizes the size of the tail pulled into the mill.

Figure 7:
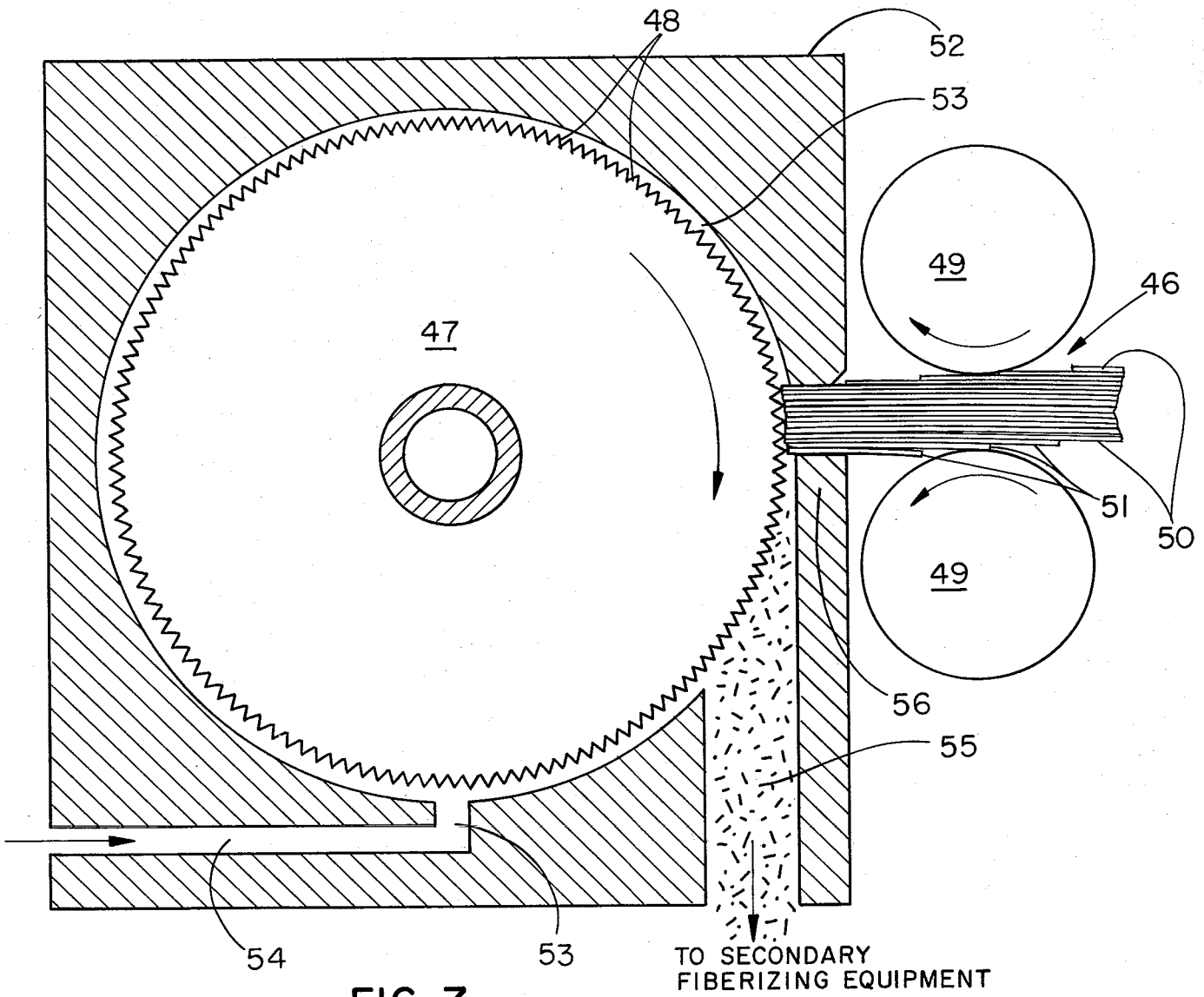
FIG. 7 is a schematic and fragmentary view in side elevation illustrating a picker type apparatus for receiving the stack of shingled sheets to be fiberized.

FIG. 7 illustrates picker type apparatus adapted to receive the stack 46 in shingled relation. Apparatus of this general type is shown in U.S. Pat. No. 3,793,678, assigned to the same assignee as the present invention. The apparatus includes a conventional picker roll 47 having picking teeth 48. The stack 46 of pulp sheets is fed generally radially to the roll at 47 by means of a pair of cooperable feed pull rolls 49. The teeth 48 divellicate the pulp sheets 50 including the tails 51 which are presented to the picking roll 47 and picking teeth 48 singly. A housing 52 encloses the picker roll 47 and provides a passage 53 between the picker roll and housing. Process air is supplied to the picker roll in the passage 53 via duct 54 and serves to aid passage of fibers through the relatively wide and open forming duct 55. As shown in FIG. 7, the rotation of the picker roll is clockwise and the tail 51 of each sheet of the stack 46 is presented to the fiberizing picker roll at the lower side of the stack. Also, the rolls 49 are positioned closely to the fiberizing zone by minimizing the wall thickness 56 between the pull rolls and the picker roll teeth. This permits retention of the sheets of the stack so as to provide a relatively short tail. The wide and open duct facilitates the passage of any material which is poorly fiberized. The latter may be recycled to an additional hammermill or the like if complete fiberization is required for a particular product.

Figure 8:
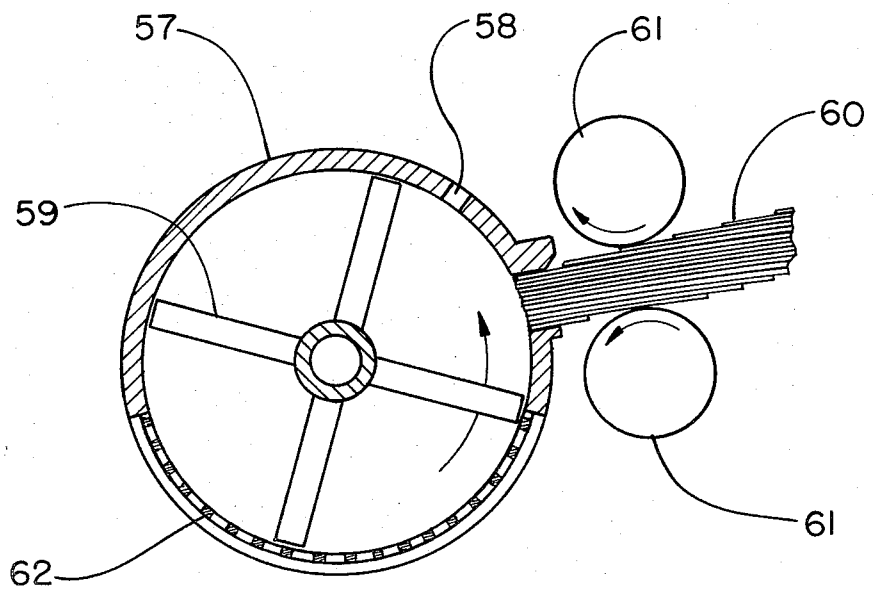
FIG. 8 is a fragmentary view of a further modification of the equipment arrangement for the practice of the process of invention.

In FIG. 8 the casing 57 of the hammermill has an opening 58 and rotors 59 similar to that of FIG. 1. In this instance the feed of the stack 60 is at an angle of about 10° to the horizontal center line passing through the hammermill and the rotors 59 in their rotation tend to draw the pulp into the mill. The feed rolls are designated at 61 and the mill screen at 62.

As many apparently widely different embodiments of this invention may be made without departing from the spirit and scope thereof, it is to be understood that I do not limit myself to the specific embodiments thereof except as defined in the appended claims.

I claim:

1. A method for separating fibers from a stack of planar pulp sheets, each of said pulp sheets being defined by forward and rearward edges and opposed lateral side edges, and defining a longitudinal axis aligned perpendicular to said forward and rearward edges, comprising:

(a) feeding said stack of pulp sheets edgewise in shingled relation to a hammermill-type fiberizing means, (b) aligning said pulp sheets to said fiberizing means such that said longitudinal axes of said pulp sheets are aligned generally radially to said rotating fiberizing means, (c) fiberizing each of said shingled pulp sheets from said forward edge to said rearward edge along said longitudinal axis such that said forward and rearward edges of each of said pulp sheets are presented to said fiberizing means substantially singly.

2. The method for separating fibers from a stack of pulp sheets as claimed in claim 1 comprising feeding said stack of pulp sheets edgewise in shingled relation to a picker-type fiberizing means.

3. A method for separating fibers from a stack of pulp sheets as claimed in claim 1, comprising feeding said stack of pulp sheets in shingled relation radially to said fiberizing means, with said forward edges of said shingled pulp sheets aligned at an acute angle to a line of travel of said shingled pulp sheets.

4. A method as claimed in claim 3, comprising feeding said stack of pulp sheets in shingled relation radially to said fiberizing means at a 45° angle to said line of travel of said shingled pulp sheets.

5. A method for separating fibers from a stack of pulp sheets as claimed in claim 1 in which the feeding of the stack of pulp sheets edgewise in shingled relation to the rotating fiberizing means is off the horizontal center line of the rotating fiberizing means.

6. A method for separating fibers from a stack of pulp sheets as claimed in claim 1 in which the direction of rotation of the fiberizing means is such that the fiberizing means contacts the main body of the stack of shingled pulp sheets prior to contacting the rearward edge of the shingled sheet which is most nearly fiberized.

7. A method for separating fibers from a stack of pulp sheets as claimed in claim 1 in which the direction of rotation of the fiberizing means relative to the stack of pulp sheets is such that the rearward edge of the sheet which is most nearly fiberized is contacted by the fiberizing means prior to contact of the fiberizing means with the main body of the stack of shingled pulp sheets.

8. A method for separating fibers from a stack of pulp sheets as claimed in claim 1 in which the lowermost sheet of the stack of pulp sheets is fed to the rotating fiberizing means substantially horizontally and is contacted by the rotating fiberizing means in its rotation prior to contact with the main body of the stack of pulp sheets.

9. A method for separating fibers from a stack of pulp sheets as claimed in claim 1 in which the rotating fiberizing means rotates on a horizontal axis and the stack of pulp sheets is fed to the fiberizing means generally horizontally and above the horizontal axis of rotation of the fiberizing means.

10. A method for separating fibers from a stack of pulp sheets as claimed in claim 1 in which the rotating fiberizing means rotates on a horizontal axis and the stack of pulp sheets is fed to the fiberizing means at an acute angle to the horizontal axis.

11. A method as claimed in claim 10 in which the stack of pulp sheets is fed at an acute angle to and above the horizontal axis.

12. A method for separating fibers from a plurality of stacks of planar pulp sheets, each of said pulp sheets being defined by a forward and rearward edge and opposed lateral side edges, and defining a longitudinal axis aligned perpendicular to said forward and rearward edges, comprising:

(a) feeding said plurality of stacks of pulp sheets edgewise in shingled relation to a hammermill-type fiberizing means, (b) aligning said plurality of stacks of pulp sheets to said fiberizing means such that said longitudinal axes of said pulp sheets within each of said stacks of pulp sheets are aligned generally radially to said rotating fiberizing means, (c) fiberizing each of said shingled pulp sheets within each of said plurality of stacks from said forward edge to said rearward edge along said longitudinal axis such that said forward and rearward edges of each of said pulp sheets are presented to said fiberizing means substantially singly, and (d) positioning said stacks of shingled pulp sheets such that at least one stack of pulp sheets is contacted by said fiberizing means above a horizontal axis through an axis of rotation of said fiberizing means and at least one stack of pulp sheets is contacted by said fiberizing means below said horizontal axis.

13. The method for separating fibers from a plurality of stacks of pulp sheets as claimed in claim 12 comprising feeding said plurality of stacks of pulp sheets edgewise in shingled relation to a picker-type fiberizing means.

* * * * *